US006098695A

United States Patent [19]

Schwingle

[11] Patent Number: 6,098,695

[45] Date of Patent: Aug. 8, 2000

[54] STABILIZER ARM FOR A FOLDING DOOR

[75] Inventor: James P. Schwingle, Cuba City, Wis.

[73] Assignee: Rite-Hite Holding Corporation, Milwaukee, Wis.

[21] Appl. No.: 09/197,172

[22] Filed: Nov. 20, 1998

[51] Int. Cl.[7] ..... E05D 15/26

[52] U.S. Cl. ..... 160/199; 160/196.1; 16/87 R; 16/94 R

[58] Field of Search ..... 160/117, 118, 160/196.1, 201, 206, 210, 213; 16/87 R, 87.2, 90, 91, 94 R, 96 D; 49/141, 118

[56] References Cited

U.S. PATENT DOCUMENTS

| | | | |
|---|---|---|---|
| 2,717,033 | 9/1955 | Breslow et al. | 160/199 |
| 3,249,211 | 5/1966 | Gray | 16/87 R X |
| 4,102,007 | 7/1978 | Janson | 16/94 |
| 4,228,738 | 10/1980 | Forshee | 16/94 R X |
| 4,503,637 | 3/1985 | Parente | 49/141 |
| 4,852,628 | 8/1989 | Klein | 160/199 |
| 4,887,659 | 12/1989 | West | 160/196.1 X |
| 4,991,257 | 2/1991 | Eutebach | 160/196.1 X |
| 5,085,261 | 2/1992 | Bortoluzzi | 160/199 |
| 5,097,883 | 3/1992 | Robinson et al. | 160/199 X |
| 5,920,956 | 7/1999 | Salice | 160/199 X |

*Primary Examiner*—Daniel P. Stodola
*Assistant Examiner*—Bruce A. Lev

[57] ABSTRACT

A powered folding door, comprising several side-by-side door panels, includes a stabilizer that resists a reactive torque created by the inertial changes of a door panel that quickly accelerates and decelerates at the door's open and closed positions. A trolley, driven back and forth along the length of an overhead track by a long narrow drawbar, suspends one of the door panels about a swivel connection. As the door closes or folds open, the swivel allows the door panel to rotate about a vertical axis to facilitate the folding action of the door. The stabilizer extends rigidly from the trolley to slidingly or rollingly engage the track at a point beyond the vertical axis of the swivel to counteract the reactive torque. The stabilizer engaging a relatively sturdy track, prevents the trolley from transmitting the torque to the drawbar (which is much weaker than the track), and thus avoids bending the drawbar.

17 Claims, 3 Drawing Sheets

STABILIZER ARM FOR A FOLDING DOOR

BACKGROUND OF THE INVENTION

1. Field of the Invention

The subject invention generally pertains to folding doors and more specifically to powered folding doors.

2. Description of Related Art

Doors that are powered open and closed as opposed to being manually operated are used in a variety of applications. Some doorways are so large that opening and closing a large, heavy door manually would be physically difficult. At doorways frequently traveled by vehicles, a driver can easily operate a powered door without having to leave the vehicle. And a door separating two areas where in one the environment (e.g., temperature, humidity or cleanliness) is controlled and the other is not, it can be important to minimize the time that the door is open to avoid degrading or contaminating the controlled environment. For example, a warehouse having refrigerated/freezer areas for storing large containers or pallets of frozen foods, produce or other perishable foods is an ideal application for a rapidly moving powered door, as the areas' temperature is controlled and the goods are frequently delivered and removed through the doorway by a forklift truck.

Many doors, such as horizontal sliding, vertically operated and conventional swinging doors require a significant amount of dead-space into which the door extends when open. The wasted space may need to be off to one or both sides of the doorway, overhead, or immediately in front of the door. However, accordion-style folding doors fold upon themselves as they open, which make them suitable for a wide variety of installations.

Folding doors typically include several side-by-side vertically elongated panels that hang from an overhead track. Often the panel's vertical edges are hinged to each other in an accordion fashion. An overhead chain and sprocket drive unit opens or closes the door by pulling at least one of the panels along the track while the others follow. With enough horsepower door operation can be quite rapid, but its speed may be limited by insufficient rigidity at the interface coupling the drive unit to the door panels.

In some cases the rigidity is improved by replacing part of the drive unit's chain with two rigid elongated drawbars that do not stretch, sag or whip around as freely as a chain. One example of such a folding door is disclosed in U.S. Pat. No. 5,295,527, which is specifically incorporated by reference herein. The patent discloses a folding door that has two narrow drawbars running generally parallel to the overhead track and each being rigidly coupled to a trolley from which one of the door panels hang. A chain (powered by a reversible motor-driven sprocket) moves each drawbar longitudinally to move their respective trolley, and the door panel hanging from it, back and forth along the track to open and close the door. Further rigidity is achieved by having the drawbars slide within close-fitting horizontal guide sleeves that are fixed in relation to the track. Although effective, the factor limiting the speed of the door can then become the drawbar's ability to resist the torque or bending moments created by changes in the driven panel's inertia as the door quickly accelerates or decelerates upon approaching and departing from its open and closed positions.

In closing the door, for example, as the driven trolley quickly stops at the closed position, the momentum of the door panel hanging from that trolley tends to keep the panel moving. Since the panel's trolley has stopped, the panel tends to swing about the trolley in the direction it was traveling. The swinging action applies a torque to the trolley, which is transmitted to the drawbar coupled to it. Since the drawbar is kept from rotating within a fixed horizontal guide sleeve, the drawbar is subjected to a substantial bending stress generally between where the drawbar enters the sleeve and where the drawbar connects to the trolley. A similar adverse effect occurs as the door decelerates/stops at its open position and also occurs as the door quickly accelerates from its closed or open positions. When the bending stress is sufficient to permanently deform the drawbar, the bent drawbar tends to repeatedly bind within the close sliding-fit of the guide sleeve. This places an added load on the drive unit, which can lead to premature wear and failure of the drive unit and other parts of the door. Although the drawbar could be made to withstand higher bending stresses by increasing its diameter, a larger diameter drawbar adds weight, size, product cost, frictional drag in the guide sleeve and inertia of its own that may further limit the speed of the door.

SUMMARY OF THE INVENTION

In order to avoid bending a drawbar and resist the torque created by the inertial changes of a door panel as it quickly accelerates and decelerates while opening and closing, there is provided folding door that includes a stabilizer. A trolley suspends the door panel from an overhead track for movement along the length of the track as well as rotational movement about a generally vertical axis. The stabilizer extends from the trolley to engage the track at a point beyond the vertical axis to counteract the torque.

Such a folding door reduces the bending stresses that are exerted against a drawbar.

In a preferred embodiment, torque created by the inertia of the door panel is counteracted by a stabilizer that is biased to one side of door panel's vertical rotational axis, so as not limit the extent to which the folding door can open.

In some embodiments, the stabilizer provides some vertical clearance to allow for track thickness tolerances yet adequately resists rotation of the trolley by placing that clearance a significant horizontal distance away from the door panel's vertical rotational axis.

DESCRIPTION OF THE PREFERRED EMBODIMENT

Figure 2:
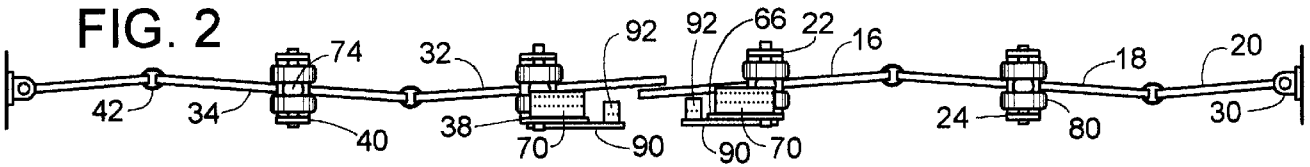
FIG. 2 is the top view of FIG. 1, but with the track and other portions of the drive unit omitted for clarity.
Figure 1:
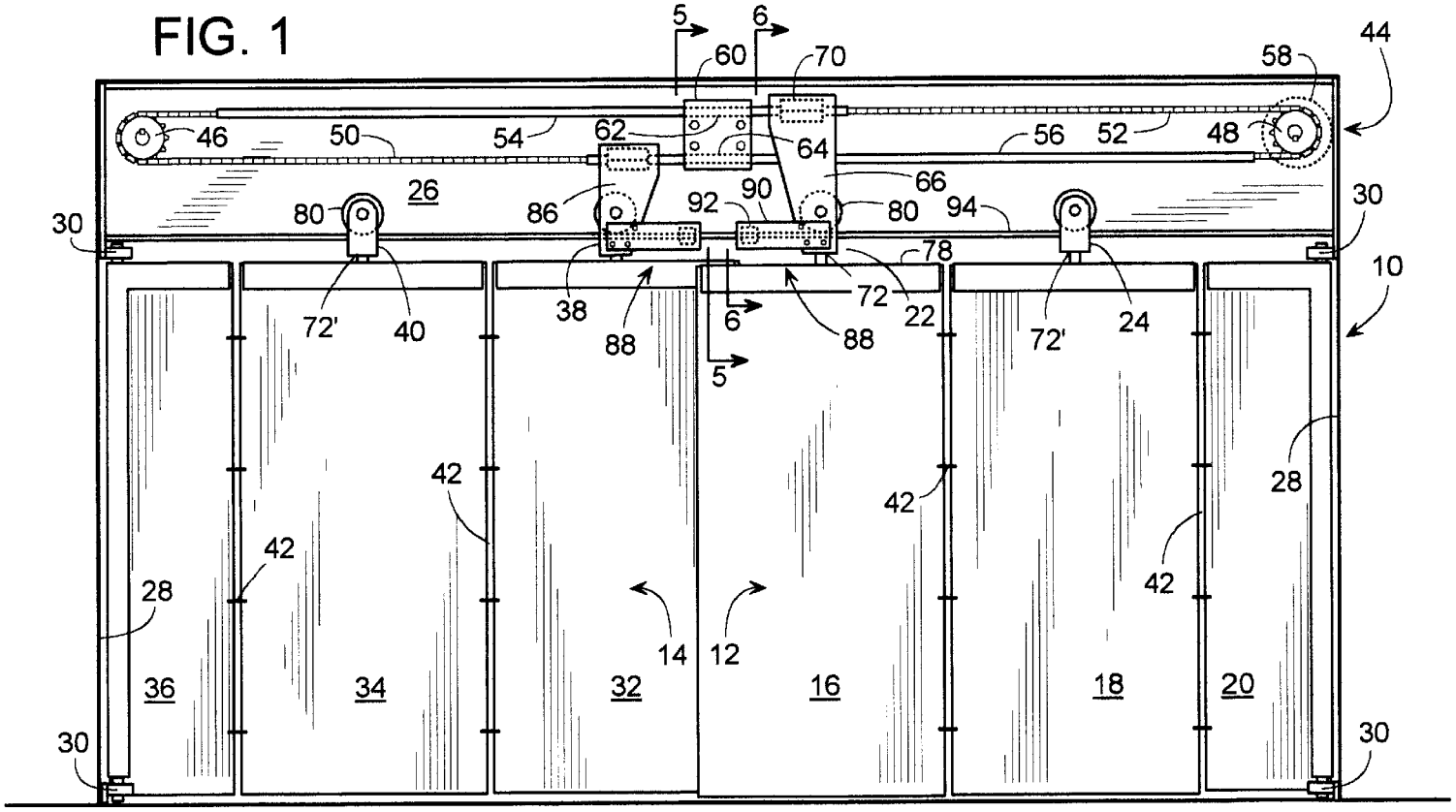
FIG. 1 is a front view of one embodiment of a folding door in its closed position.
Figure 4:
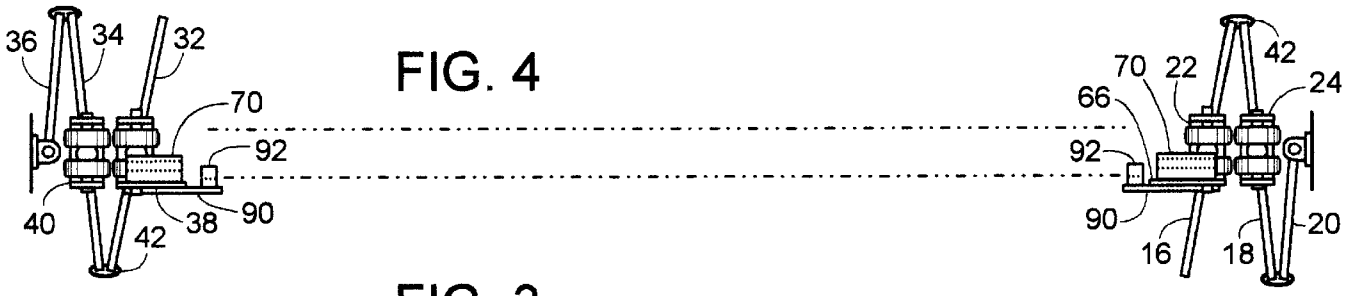
FIG. 4 is the top view of FIG. 3, but with the track and other portions of the drive unit omitted for clarity.
Figure 3:
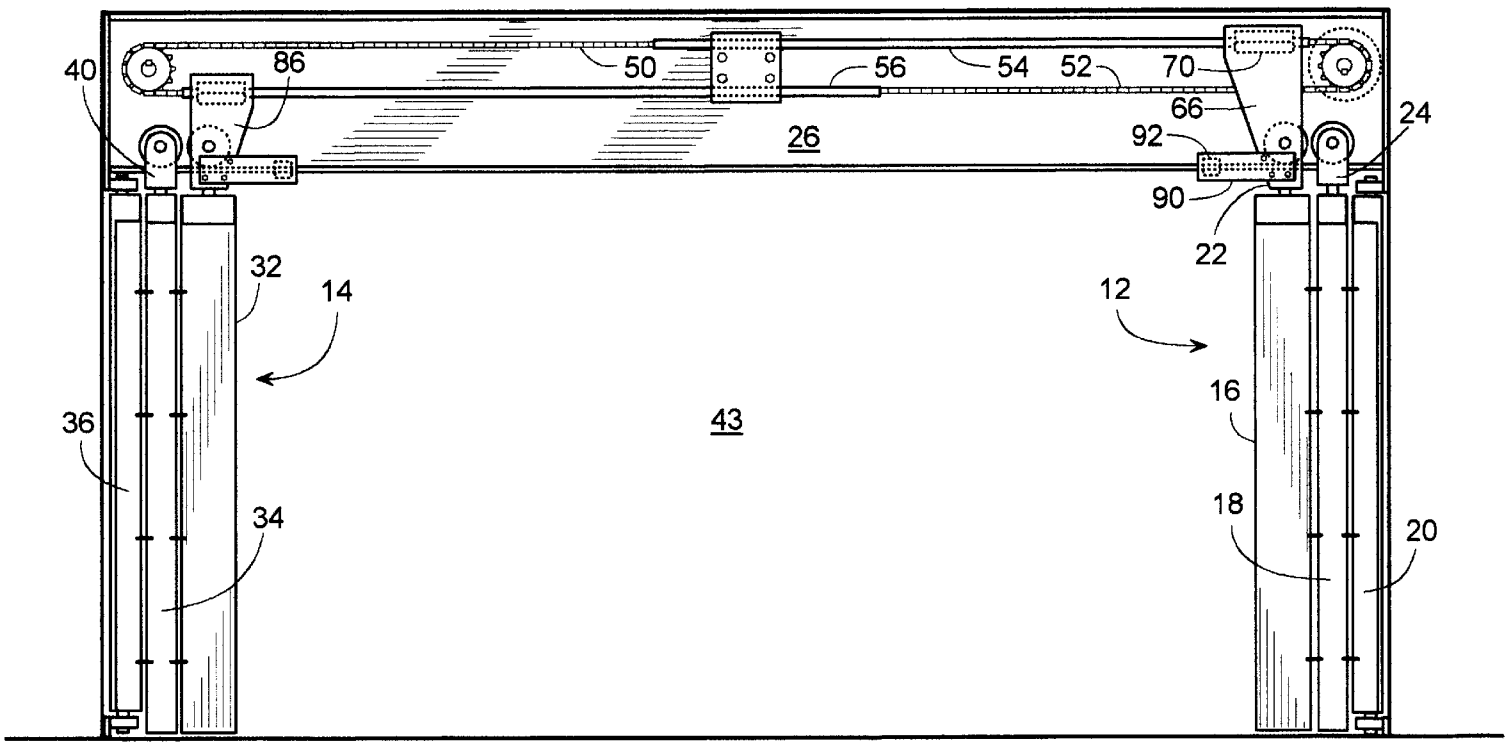
FIG. 3 is a front view of the embodiment of FIG. 1, but with the door in its open position.

One example of a folding door that incorporates a stabilizer for preventing the door's drawbars from bending is shown in the embodiment of FIGS. 1–5. In this example, a folding door 10 generally includes a right half 12 and a left half 14 with each half comprising three panels. For the panels on the right, two panels 16 and 18 are suspended by trolleys 22 and 24 that travel along an overhead track 26 (e.g., an I-beam), and the third 20 is pivotally attached to a side frame 28 of the doorway by hinges 30. Likewise, for the panels on the left, panels 32 and 34 and are suspended by trolleys 38 and 40, while panel 36 is pivotally attached to frame 28 by hinges 30. Although the panels can be made of most any material including wood, metal and a variety of plastics, in some embodiments, the panels consist of a thermally insulating core protected by a tough outer layer such as HYPALON, canvas duck, or a coated nylon fabric. The three panels of each half of the door have their vertical edges interconnected by folding joints 42, provided by rings looped through grommets or vertically elongated flexible strips that are sewn, glued or attached by a touch and hold fastener such as VELCRO. The panels' folding joints 42 allow each half of door 10 to move in an accordion-like manner to and away from a center 43 of the doorway to respectively close and open the door. FIGS. 1 and 2 show the front and top views of door 10 closed, and FIGS. 3 and 4 show the door open. The top views of FIGS. 2 and 4 show the door with track 26 and a drive unit 44 omitted to more clearly show the remaining parts of the door.

In opening and closing door 10, drive unit 44, disposed on a C-channel 46 above track 26, drives the two inner panels 16 and 32 back and forth along the track in opposite directions. Upon doing so, the two outer panels 18 and 20 on the right follow or react to the movement of panel 16, while the other two outer panels 34 and 36 on the left respond to the movement of panel 32. Although the actual construction of the drive unit can obviously vary, in one exemplary embodiment drive unit 44 includes two sprockets 46 and 48 that engagingly support two roller chain segments 50 and 52 that are interconnected by two drawbars: an upper one 54 and a lower one 56. A reversible motor 58 (e.g., a gearmotor comprising a combination motor and gearbox) drives sprocket 48, while sprocket 46 serves as an idler, so that chains 50 and 52 pull drawbars 54 and 56 back and forth in opposite directions. As with conventional folding doors, stopping the drive motor and limiting the drawbars' range of motion can be done by installing one or more standard limit switches where desired. The linear movement of the drawbars is generally parallel to track 26 and is guided by a guide block 60 having two integral guide sleeves (e.g., bores 62 and 64) through which the drawbars freely slide. In one embodiment, upper drawbar 54 is coupled to the right inner panel 16 and lower drawbar 56 is coupled to the left inner panel 32, such that as the drawbars are driven back and forth, so are their corresponding inner panels.

Figure 5:
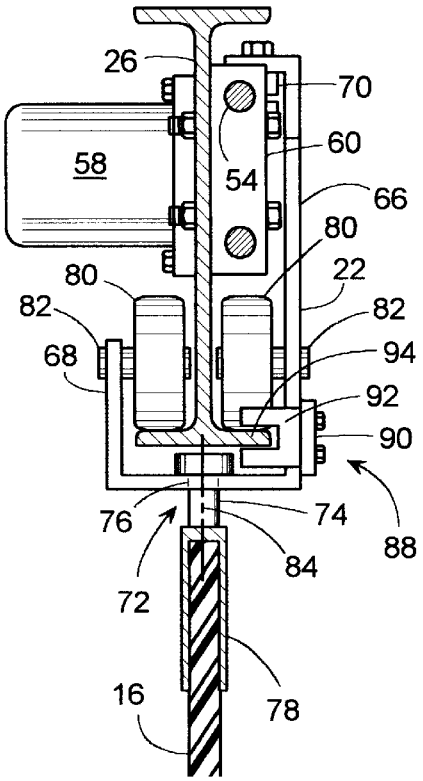
FIG. 5 is a cross-sectional end view taken along line 5—5 of FIG. 1.
Figure 6:
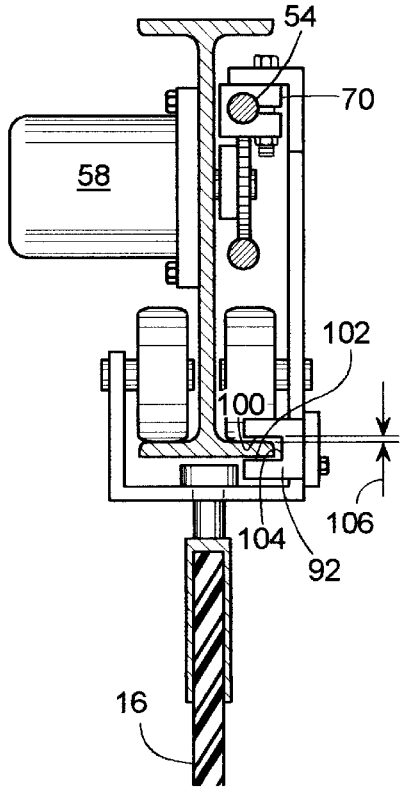
FIG. 6 is a cross-sectional end view taken along line 6—6 of FIG. 1.

One way of coupling a drawbar to a door panel (e.g., upper drawbar 54 to right inner panel 16) is by way of a bracket 66, as shown in FIGS. 5 and 6. In this example, bracket 66 is an integral extension of a frame 68 of trolley 22 and includes a clamp 70 that tightly grips drawbar 54. A swivel connection 72, such as a shouldered pin 74 rotatably extending through a slip-fit hole 76 in the bottom of frame 68, connects a hanger frame 78 of panel 16 to trolley frame 68, and thus couples door panel 16 to drawbar 54 through bracket 66. Rollers 80, whose axles 82 extend from frame 68, allow trolley 22 and its door panel 16 to roll along track 26, while swivel 72 allows door panel 16 to pivot about a generally vertical axis 84 as folding door 10 opens and closes. The lower drawbar 56 can be coupled to the left inner trolley 38 and its door panel 32 in a similar fashion, but with a shorter bracket 86.

Figure 7:
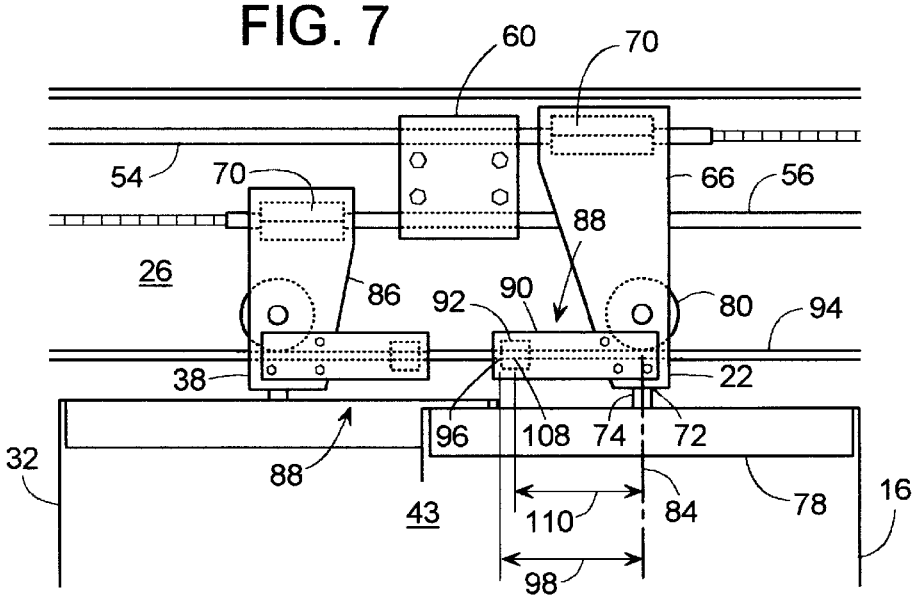
FIG. 7 is an enlarged view of an upper central portion of FIG. 1.

As a door panel's trolley 22 or 38 quickly accelerates or decelerates at the door's open or closed position, the brackets' tendency to bend its corresponding drawbar under the impetus of the inner door panel's change in inertia can be counteracted by a stabilizer 88. For example, stabilizer 88 can include an arm 90 extending from trolley 22. A guide 92 attached to a distal end of arm 90 and slidingly (or rollingly) engaging track 26 at, for example, its lower flange 94 provides a contact point 96 against track 26 that is spaced apart from vertical axis 84 to define a span 98, as shown in FIG. 7. Contact point 96 at span 98 creates a counter torque that opposes the inertial effects of the inner door panels' 16 rapidly starting or stopping. The counter torque is created by stabilizer 88 acting upon a strong I-beam track 26 as opposed to a much weaker drawbar 54. That is, drawbar 54, although relatively rigid, is fixed at its ends to a nonrigid chain. Consequently, stabilizer 88 tends to keep its bracket 66 square to the track 26 and its corresponding door panel 16 hanging vertically, as opposed to swinging excessively from left to right (i.e., to and away from the center of the doorway). It should be noted that stabilizer 88 is schematically illustrated to encompass other configurations that are well within the scope of the invention. For example, while shown as a separate member 88, the stabilizer could also take the form of an integral extension of the frame 68 of the trolley 22 along the track, which would include a guide (like 92) for engaging one or both surfaces of the I-beam flange.

In a currently preferred embodiment, however, stabilizer 88 is a separate member including guide 92 in the form of a positioning gib or bearing/wear pad consisting of an ultra-high molecular weight polyethylene (i.e., UHMW); however, other plastics or metals could also work. Further, exemplary guide 92 is shown to include an upper guide surface 100, a lower guide surface 102 and a lateral guide surface 104; however, one or more of these surfaces may be eliminated and still provide some resistance to the bending of drawbar 54. Guide 92 could also be a roller or a set of opposed rollers on either side of the track to provide less frictional resistance than a sliding interface. It should also be noted that some vertical clearance 106 is provide between guide 92 and the thickness of the I-beam's lower flange 94 to allow for thickness variation due to dimensional tolerances of standard I-beams. Clearance 106 also minimizes frictional drag between the guide 92 and track 26, as it is the main bearing unit (e.g., rollers 80 and axle 82) that supports most of the door panel's weight. Although, vertical clearance 106 may increase the degree to which door panel 16 can swing, and possibly bend drawbar 54, the amount of swing can still be minimized by simply increasing span 98 between the guide's contact point 96 and swivel connection.

Increasing the stabilizer span 98 at the two inner panels 16 and 32 can be achieved without limiting the extent to which door 10 can open by providing the inner panel trolleys 22 and 38 with a broader span than that of the other trolleys. For example, in the illustrated embodiment, the anti-rotation span for the outer door panels 18 and 34 is basically zero, as trolleys 24 and 40 contact track 26 at a rolling line contact directly above their swivel connections 72' (as viewed from the front of the doorway, e.g., FIGS. 1 and 3). This avoids creating interference between the stabilizer of an inner trolley and that of an adjacent outer trolley so that door 10 can fully open. Clearance between adjacent trolleys 22 and 24 as well as between 38 and 40, can also be achieved by having the stabilizer span 98 at the two inner panels 16 and 32 be biased off to one side of their swivel connection towards the center of the doorway (i.e., away from their adjacent outer trolley 24 and 40 respectively). It should also be noted that whether guide 92 is a gib, roller or set of rollers, the pad may actually contact track 26 at a plurality of points, and the center of those points 108 is displaced from swivel 72 at a distance referred to as a center offset distance 110. In a preferred embodiment, the center offset distance is also biased towards the center of the doorway to optimize the stabilizer's ability to keep its bracket square to the track and resist the inner panels' tendency to swing.

Although the invention is described with reference to a presently preferred embodiment, it should be appreciated by those skilled in the art that various modifications are well within the scope of the invention. For example, various seals can be added around the perimeter of the door and/or between the individual door panels, and various shrouds might be added for functional or aesthetic reasons. Instead of adjacent panels being interconnected edge to edge, the panels may be interconnected with some overlap of the panels' vertical edges. The number of panels can be more or less than three on each half of the doorway, or the panels could all fold over to one side of the doorway rather than being split evenly down the center and drawn to each side. The track could be something other than an I-beam, the trolleys could have a main bearing unit with more or less rollers and the stabilizer could be centrally disposed above the trolleys swivel connection (as viewed from the front of the doorway, e.g., FIGS. 1 and 3). Therefore, the scope of the invention is to be determined by reference to the claims that follow.

I claim:

1. A door, comprising:

an overhead track;

a first trolley mounted to travel along the track in a first travel direction and a second travel direction opposite the first travel direction;

a first panel suspended from, and rotatably coupled to, the first trolley by way of a first swivel; and a stabilizer coupled to the first trolley and having a contact point that engages the track at a distance from the first swivel to limit the extent to which the first trolley can rotate about a horizontal axis perpendicular to the first travel direction;

wherein the stabilizer includes an upper guide that engages the track in a downward direction and a lower guide that engages the track in an upward direction.

2. The door of claim 1, further comprising a second panel hinged to the first panel and being rotatably coupled to the track by way of a second trolley, and wherein the contact point associated with the first trolley is horizontally spaced apart from the first swivel to define a span that is greater than any corresponding span associated with the second trolley.

3. The door of claim 1, wherein the stabilizer includes a plurality of contact points collectively having a center that is horizontally spaced apart from the first swivel to define a center offset distance.

4. The door of claim 3, wherein the center is horizontally offset from the first swivel in a direction that the first trolley travels along the track to close the door.

5. The door of claim 3, further comprising a second panel rotatably coupled to the track by way of a second trolley, and wherein the center offset distance associated with the first trolley is greater than any corresponding center offset distance associated with the second trolley.

6. The door of claim 1, wherein the stabilizer includes a gib in sliding relationship with the track to provide the contact point.

7. The door of claim 1, wherein the stabilizer includes a roller to provide the contact point.

8. The door of claim 1, wherein the first trolley exerts a greater downward force against the track than does the upper guide when the first trolley is at rest.

9. The door of claim 1, wherein the stabilizer includes a lateral guide that engages the track in at least a partially horizontal direction to limit the extent to which the first trolley might otherwise rotate about a vertical axis.

10. The door of claim 1, wherein the track is an I-beam and the contact point engages a bottom surface of a lower flange of the I-beam.

11. The door of claim 1, wherein the stabilizer includes a second contact point that engages the track at an elevation higher than that of the first contact point.

12. A folding door, comprising:

an overhead track;

a first trolley mounted to travel along the track by way of a main bearing unit in a first direction and a second direction opposite the first direction;

a first panel suspended from, and rotatably coupled to, the first trolley by way of a first swivel;

a second panel hinged to the first panel and being rotatable in relation to the track;

a stabilizer coupled to the first trolley and having a contact point that engages the track in opposition to the main bearing unit to limit the extent to which the first trolley can rotate about a horizontal axis perpendicular to the first direction; and a second trolley that rotatably couples the second panel to the track, and wherein the contact point associated with the first trolley is horizontally spaced apart from the first swivel to define a span that is greater than any corresponding span associated with the second trolley;

wherein the stabilizer includes an upper guide that engages the track in a downward direction and a lower guide that engages the track in an upward direction.

13. The folding door of claim 12, wherein the stabilizer includes a plurality of contact points collectively having a center that is horizontally spaced apart from the first swivel to define a center offset distance.

14. The folding door of claim 13, wherein the center is horizontally offset from the first swivel in a direction that the first trolley travels along the track to close the folding door.

15. The folding door of claim 13, wherein the center offset distance associated with the first trolley is greater than any corresponding center offset distance associated with the second trolley.

16. The folding door of claim 12, wherein the main bearing exerts a greater downward force against the track than does the upper guide when the first trolley is at rest.

17. A folding door, comprising:

an overhead track;

a first trolley mounted to travel along the track by way of a main bearing unit in a first direction and a second direction opposite the first direction;

a first panel suspended from, and rotatably coupled to, the first trolley by way of a first swivel;

second panel hinged to the first panel and being rotatable in relation to the track;

a stabilizer coupled to the first trolley and having a plurality of contact points that engage the track in opposition to the main bearing unit to limit the extent to which the first trolley can rotate about a horizontal axis perpendicular to the first direction, and wherein the plurality of contact points collectively has a center that is horizontally offset from the first swivel in a direction that the first trolley travels along the track to close the folding door; and a second trolley that rotatably couples the second panel to the track, and wherein the center of the plurality of contact points associated with the first trolley is horizontally spaced apart from the first swivel to define a span that is greater than any corresponding span associated with the second trolley;

wherein the stabilizer includes an upper guide that engages the track in a downward direction and a lower guide that engages the track in an upward direction.

* * * * *